US006329133B1

(12) United States Patent
Andrievsky et al.

(10) Patent No.: US 6,329,133 B1
(45) **Date of Patent: *Dec. 11, 2001**

(54) COLOR PHOTOGRAPHIC MATERIAL HAVING ENHANCED LIGHT ABSORPTION

(75) Inventors: Andrei Andrievsky; Richard L. Parton, both of Webster; Thomas L. Penner, Fairport; William J. Harrison, Pittsford, all of NY (US)

(73) Assignee: Eastman Kodak Company, Rochester, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/394,821

(22) Filed: Sep. 13, 1999

(51) Int. Cl.[7] ..... G03C 1/10; G03C 1/29

(52) U.S. Cl. ..... 430/572; 430/574; 430/576; 430/577; 430/578; 430/579; 430/580; 430/581; 430/582; 430/583; 430/584; 430/585; 430/586; 430/587; 430/588; 430/590; 430/591; 430/592; 430/593; 430/594; 430/595

(58) Field of Search ..... 430/572, 574, 430/576, 577, 578, 579–588, 590–595

(56) References Cited

U.S. PATENT DOCUMENTS

| | | | |
|---|---|---|---|
| 2,518,731 | 8/1950 | Thompson . | |
| 3,622,316 | 11/1971 | Bird et al. . | |
| 3,976,493 | 8/1976 | Borror et al. . | |
| 3,976,640 | 8/1976 | Borror et al. . | |
| 4,040,825 | 8/1977 | Steiger et al. . | |
| 4,138,551 | 2/1979 | Steiger et al. . | |
| 4,518,689 | 5/1985 | Noguchi et al. . | |
| 4,950,587 | 8/1990 | Roberts et al. . | |
| 5,422,423 * | 6/1995 | Shacklette et al. | 528/422 |

FOREIGN PATENT DOCUMENTS

| | | |
|---|---|---|
| 0270082B1 | 6/1988 | (EP) . |
| 0565074A2 | 10/1993 | (EP) . |
| 0270079B1 | 3/1994 | (EP) . |
| 0838719A2 | 4/1998 | (EP) . |
| 1091134 | 4/1989 | (JP) . |
| 10171058 | 6/1998 | (JP) . |

OTHER PUBLICATIONS

George R. Bird, Overcoming the Limitation of Incomplete Absorption in Sensitization with Cyanine Dyes Sep./Oct. 1974, pp. 562–568, Photographic Science andf Engineering, vol. 18.

Th. Forester, 10$^{th}$ Spiers Memorial Lecture Transfer Mechanisms of Electronic Excitation, Apr. 1959, pp. 7–17, Energy Transfer With Special Reference to Biological Systems, No. 27.

R. Steiger, Gelatin–Substituted Cyanine Dyes as Spectral Sensitizers for Silver Halide Emulsions, 1983, pp. 59–95, Photographic Science and Engineering, vol. 27.

Thomas L. Penner, Electrophoresis of Spectral Sensitizing Dyes on Silver Halide: Evidence for Dye Layering, 1977, pp. 32–36, Photographic Science and Engineering, vol. 21.

Thomas L. Penner, P.B. Gilman, Jr., Spectral Shifts and Physical Layering of Sensitizing Dye Combinations in Silver Halide Emulsions, 1976, Photographic Science and Engineering, vol. 20.

* cited by examiner

*Primary Examiner*—Thorl Chea
(74) *Attorney, Agent, or Firm*—Edith A. Rice

(57) ABSTRACT

This invention comprises a silver halide photographic material comprising at least one silver halide emulsion comprising silver halide grains having associated therewith a combination of two or more dyes wherein (b) (a) a dye having at least one substituent that has a negative charge is present, a dye having at least one substituent that has a positive charge is present, wherein at least one of the dyes is further substituted with at least one hydrogen bonding donor substituent.

In a preferred embodiment, at least one of the dyes is substituted with at least two hydrogen bonding donor substituents.

In another preferred embodiment a silver halide photographic material comprises at least one silver halide emulsion comprising silver halide grains having associated therewith a dye substituted with at least one guanidinium, amidinium, or imine of urea substituent.

25 Claims, No Drawings

COLOR PHOTOGRAPHIC MATERIAL HAVING ENHANCED LIGHT ABSORPTION

CROSS REFERENCE TO RELATED APPLICATIONS

This application is related to the following commonly assigned, co-pending applications: U.S. application Ser. No. 09/151,974 filed Sep. 11, 1998; U.S. application Ser. No. 09/151,915 filed Sep. 11, 1998; U.S. application Ser. No. 09/151,916 filed Sep. 11, 1998; U.S. application Ser. No. 09/151,977 filed Sep. 11, 1998; U.S. application Ser. No. 09/394,912, filed Sep. 13, 1999. The entire disclosures of these related applications are incorporated herein by reference.

FIELD OF THE INVENTION

This invention relates to a silver halide color photographic material containing at least one silver halide emulsion having enhanced light absorption.

BACKGROUND OF THE INVENTION

J-aggregating cyanine dyes are used in many photographic systems. It is believed that these dyes adsorb to a silver halide emulsion and pack together on their "edge" which allows the maximum number of dye molecules to be placed on the surface. However, a monolayer of dye, even one with as high an extinction coefficient as a J-aggregated cyanine dye, absorbs only a small fraction of the light impinging on it per unit area. The advent of tabular emulsions allowed more dye to be put on the grains due to increased surface area. However, in most photographic systems, it is still the case that not all the available light is being collected.

Increasing the absorption cross-section of the emulsion grains should lead to an increased photographic sensitivity. The need is especially great in the blue sensitization of the yellow layer of color negative photographic elements. This is because not all incident blue light is absorbed by the typical blue-sensitive emulsions in practical multilayer films. Higher speed in this layer can be used to obtain improved color and image quality characteristics.

One way to achieve greater light absorption is to increase the amount of spectral sensitizing dye associated with the individual grains beyond monolayer coverage of dye (some proposed approaches are described in the literature, G. R. Bird, *Photogr. Sci. Eng.,* 18, 562 (1974)). One method is to synthesize molecules in which two dye chromophores are covalently connected by a linking group (see U.S. Pat. Nos. 2,518,731, 3,976,493, 3,976,640, 3,622,316, Kokai Sho 64(1989)91134, and EP 565,074). This approach suffers from the fact that when the two dyes are connected they can interfere with each other's performance, e.g., not aggregating on or adsorbing to the silver halide grain properly.

In a similar approach, several dye polymers were synthesized in which cyanine dyes were tethered to poly-L-lysine (U.S. Pat. No. 4,950,587). These polymers could be combined with a silver halide emulsion, however, they tended to sensitize poorly and dye stain (an unwanted increase in D-min due to retained sensitizing dye after processing) was severe in this system and unacceptable.

A different strategy involves the use of two dyes that are not connected to one another. In this approach the dyes can be added sequentially and are less likely to interfere with one another. Miysaka et al. in EP 270 079 and EP 270 082 describe silver halide photographic element having an emulsion spectrally sensitized with an adsorbable sensitizing dye used in combination with a non-adsorbable luminescent dye which is located in the gelatin phase of the element. Steiger et al. in U.S. Pat. Nos. 4,040,825 and 4,138,551 describe silver halide photographic element having an emulsion spectrally sensitized with an adsorbable sensitizing dye used in combination with second dye which is bonded to gelatin. The problem with these approaches is that unless the dye not adsorbed to the grain is in close proximity to the dye adsorbed on the grain (less than 50 angstroms separation) efficient energy transfer will not occur (see T. Förster, *Disc. Faraday Soc.,* 27, 7 (1959)). Most dye off-the-grain in these systems will not be close enough to the silver halide grain for energy transfer, but will instead absorb light and act as a filter dye leading to a speed loss. A good analysis of the problem with this approach is given by Steiger et al. (*Photogr. Sci. Eng.,* 27, 59 (1983)).

A more useful method is to have two or more dyes form layers on the silver halide grain. Penner and Gilman described the occurrence of greater than monolayer levels of cyanine dye on emulsion grains, *Photogr. Sci. Eng.,* 20, 97 (1976); see also Penner, *Photogr. Sci. Eng.,* 21, 32 (1977). In these cases, the outer dye layer absorbed light at a longer wavelength than the inner dye layer (the layer adsorbed to the silver halide grain). Bird et al. in U.S. Pat. No. 3,622,316 describe a similar system. A requirement was that the outer dye layer absorb light at a shorter wavelength than the inner layer. The problem with previous dye layering approaches was that the dye layers described produced a very broad sensitization envelope. This would lead to poor color reproduction since, for example, the silver halide grains in the same color record would be sensitive to both green and red light.

Yamashita et al. (EP 838 719 A2) describes the use of two or more cyanine dyes to form dye layers on silver halide emulsions. The dyes are required to have at least one aromatic or heterocyclicaromatic substitutent attached to the chromophore via the nitrogen atoms of the dye. This is undesirable because such substitutents can lead to large amounts of retained dye after processing (dye stain) which affords increased D-min. We have found that this is not necessary and that neither dye is required to have at least one aromatic or heterocyclicaromatic substitute attached to the chromophore via the nitrogen atoms of the dye. The dyes of our invention give increased photographic sensitivity.

Yasuhiro et al. (U.S. Pat. No. 4,518,689) describe an inner latent image type silver halide photographic emulsion spectrally sensitized with a cationic monomethine dye and an anionic monmethine dye. Yamashita et al. (Japenese Kokai Patent Application No. Hei 10 [1998]-171058) describes the use of two or more dyes to form dye layers on silver halide emulsions characterized by containing an anionic dye and a cationic dye where the charge of either the anionic dye or the cationic dye is 2 or greater.

However, the methods described above do not sufficiently provide increased sensitivity. Thus, further technology is required.

PROBLEM TO BE SOLVED BY THE INVENTION

Not all the available light is being collected in many photographic systems. The need is especially great in the blue spectral region where a combination of low source intensity and relatively low dye extinction result in deficient photoresponse. The need for increased light absorption is also great in the green sensitization of the magenta layer of color negative photographic elements. The eye is most sensitive to the magenta image dye and this layer has the largest impact on color reproduction. Higher speed in this layer can be used to obtain improved color and image quality characteristics. The cyan layer could also benefit from increased red-light absorption which could allow the use of smaller emulsions with less radiation sensitivity and improved color and image quality characteristics. For certain applications it may be useful to enhance infrared light absorption in infrared sensitized photographic elements to achieve greater sensitivity and image quality characteristics.

SUMMARY OF THE INVENTION

Commonly assigned, co-pending application Ser. No. 09/151,915, filed on Sep. 11, 1998 describes increased light absorption in a photographic system. This is achieved by forming two dye layers on silver halide held together by more than one non-covalent force by use of at least one dye having at least one anionic substituent and at least one dye having at least one cationic substituent. However, we have found that increasing light absorption in this manner is less effective than desired in photographic materials that contain anionic surfactants, such as those generally used to make color coupler dispersions. We have found that blue dyes in particular, are easily attracted by other chemical species in the emulsion with affinity to blue dye molecules, which ultimately results in the disruption of the dye layers. The net result of these undesirable competitive interactions is decreased light absorption and reduced speed. We have now found that certain dye structures provide the desired enhanced light absorption in a color photographic element, including photographic elements that contain an anionic surfactant in the coupler dispersion.

We have found that it is possible to form more than one dye layer on silver halide emulsion grains and that this can afford increased light absorption. The dye layers are held together by preferably more than one non-covalent attractive force such as electrostatic bonding, van der Waals interactions, hydrogen bonding, hydrophobic interactions, dipole-dipole interactions, dipole-induced dipole interactions, London dispersion forces, cation—π interactions, etc. or by in situ bond formation.

In one preferred embodiment a silver halide photographic material comprises at least one silver halide emulsion comprising silver halide grains having associated therewith a combination of two or more dyes wherein (a) a dye having at least one substituent that has a negative charge is present, and (b) a dye having at least one substituent that has a positive charge is present, wherein at least one of the dyes is further substituted with at least one hydrogen bonding donor substituent.

In another preferred embodiment, at least one of the dyes is substituted with at least two hydrogen bonding donor substituents.

The inner dye layer(s) is adsorbed to the silver halide grains and contains at least one spectral sensitizer. Preferably the dyes of the inner layer form a J-aggregate. The outer dye layer(s) (also referred to herein as an antenna dye layer(s)) also preferably aggregates and the aggregate absorbs light at a shorter or equal wavelength, so that light energy emission wavelength of the outer dye layer overlaps with the light energy absorption wavelength of the adjacent inner dye layer. This results in increased sensitivity and improved color reproduction.

In another preferred embodiment a silver halide photographic material comprising at least one silver halide emulsion comprising silver halide grains having associated therewith a combination of two or more dyes wherein at least one dye containing at least one guanidinium or amidinium substituent provides increased light absorption. In another preferred embodiment a silver halide photographic material comprising at least one silver halide emulsion comprising silver halide grains having associated therewith a combination of two or more dyes, wherein at least one dye containing at least two guanidinium or amidinium substituents provides increased light absorption. In another preferred embodiment a silver halide photographic material comprising at least one silver halide emulsion comprising silver halide grains having associated therewith a combination of two or more dyes, wherein at least one dye containing at least one primary, secondary or tertiary ammonium substituent provides increased light absorption.

In another preferred embodiment a silver halide photographic material comprises at least one silver halide emulsion comprising silver halide grains having associated therewith a dye substituted with at least one guanidinium, amidinium, or imine of urea substituent.

ADVANTAGEOUS EFFECT OF THE INVENTION

This invention affords enhanced photographic sensitivity. The invention increases light absorption and photographic sensitivity. The increased sensitivity can also provide improved granularity by enabling the use of smaller grain size emulsions. The relatively slow speed of the small grain emulsions is compensated for by the increased light absorption of the dye layers of the invention. In addition to improved granularity, the smaller emulsions would have lower ionizing radiation sensitivity, which is determined by the mass of silver halide per grain. Further the invention can provide good color reproduction.

DETAILED DESCRIPTION OF THE INVENTION

As mentioned above, in preferred embodiments of the invention silver halide grains have associated therewith dyes layers that are held together by non-covalent attractive forces. Examples of non-covalent attractive forces include electrostatic attraction, hydrophobic interactions, hydrogen-bonding, van der Waals interactions, dipole-dipole interactions, dipole-induced dipole interactions, London dispersion forces, cation—π interactions or any combinations of these. Cooperative combination of several non-covalent binding forces, one of them being hydrogen bonding, is preferred. Cooperative binding is based on many reinforcing non-covalent interactions as defined in Stryer, *Biochemistry* 3$^{rd}$ edition, 1988 (Freeman and Company, New York). In another preferred embodiment at least one of the dyes is further substituted with at least one hydrogen bonding donor substituent. In a hydrogen bond, a hydrogen atom is shared by two other atoms, as defined in Stryer, *Biochemistry* 3$^{rd}$ edition, 1988 (Freeman and Company, New York). Hydrogen bonds can form between uncharged molecules as well as charged ones. The atom to which the hydrogen is more tightly linked is called the hydrogen bonding donor, whereas the other atom is the hydrogen bonding acceptor. The acceptor has a partial negative charge that attracts the hydrogen atom. The bond energies range from 2 to 9 kcal/mol. Consequently, these provide for a substantial binding strength between the dye layers. Hydrogen bonds are particularly strong between the oxoanions such as carboxylates, sulfonates, sulfinates, phosphates, phosphonates, etc. and unsubstituted or substituted ammonium, amidinium, guanidinium, etc. cations or various imines of urea as described in F. Schmidtchen, *Tetrahedron Lett.* 30, 4493 (1989) and M. D. Ward et al., *J. Am. Chem. Soc.* 116, 1941 (1994). This is because a combination of electrostatic attractions with hydrogen bonding results in higher overall binding strength as described in *Supramolecular Chemistry of Anions,* A. Bianchi, K. Bowman-James, E. Garcia-Espana, Eds., Wiley-VCH, New York, 1997. Therefore, in another preferred embodiment, a silver halide color photographic material in which silver halide grains having associated therewith a combination of two or more dyes, wherein at least one dye contains at least one guanidinium or amidinium substituent provides increased light absorption. In another preferred embodiment, a silver halide color photographic material in which silver halide grains having associated therewith a combination of two or more dyes, wherein at least one dye contains at least one primary, secondary or tertiary ammonium substituent provides increased light absorption. Ammonium group means protonated amino group. Alkylammonium or arylammonium groups could be used, as well as ammonium groups containing heterocyclic functional groups. Ammonium groups here also encompass groups in which nitrogen atom is attached to another nitrogen atom, to oxygen atom, or to sulfur atom, e.g., salts of diazanes, triazanes, diazenes, triazenes, azanols (hydroxylamines), azanethiols, oximes, etc. Other examples can include imino-groups, e.g., cyanoimino, hydroxyimino, mercaptoimino, hydrazo, hydrazono, azo, azino, etc. It is understood, that a hydrogen bonding donor and positive charge are not necessarily located on the same substituent. We found that binding between two dye molecules is especially robust when one of the dyes has at least one multidentate oxoanion, e.g., carboxylate, sulfonate, sulfinate, phosphate, phosphonate, etc. We found that binding between two dye molecules is further strengthened when one of them has two or more such oxoanions and the other is substituted with two or more unsubstituted or substituted ammonium, amidinium, guanidinium, etc. cations or various imines of urea. Therefore, in another preferred embodiment, a silver halide color photographic material in which silver halide grains having associated therewith a combination of two or more dyes, wherein at least one dye contains at least two hydrogen bonding donor substituents is preferred. In another preferred embodiment, a silver halide color photographic material in which silver halide grains having associated therewith a combination of two or more dyes, wherein at least one dye containing at least two guanidinium or amidinium substituents provides increased light absorption. Guanidinium and amidinium substituents have both a positive charge and hydrogen bonding donors. We have found that layers formed by dyes substituted with two guanidinium or amidinium groups are much more robust in color systems than analogous layers that are held only by electrostatic forces.

We have also found that layers formed by dyes substituted with two primary, secondary or tertiary alkylammonium groups are robust in color systems. Primary, secondary or tertiary alkylammonium substituents have both a positive charge and hydrogen bonding donors. In another preferred embodiment, a silver halide color photographic material in which silver halide grains having associated therewith a combination of two or more dyes, wherein at least one dye contains at least two ammonium substituents, and at least one ammonium group is primary, secondary or tertiary is preferred. Other substituents which have groups formed by protonation of an atom carrying an unshared pair of electrons can also be used, e.g. phosphonium, sulfonium, etc.

In another preferred embodiment, the positive charge on the dye substituent is formed in situ in the emulsion by protonation. This is possible when such dye substituent has a pKa value of a conjugate acid which is equal to or higher than 5. Typical pKa values are well known, and are tabulated in, e.g., J. A. Dean *Lange's Handbook of Chemistry,* 13$^{th}$ edition, Mc-Graw Hill, N.Y., 1985 and D. D. Perrin *Dissociation Constants of Organic Bases in Aqueous Solution,* Butterworths, London, 1965.

Preferably the dyes of the inner layer (the primary sensitizer) form a J-aggregate. For a discussion of J-aggregation see *The Theory of the Photographic Process,* 4$^{th}$ edition, T. H. James, editor, Macmillan Publishing Co., New York, 1977). The outer dye layer(s) also preferably aggregate. The aggregation properties of a dye can be determined by coating the dye on a silver halide emulsion. The wavelength of maximum light absorbance and sensitization of the dye can be determined from the coatings by spectroscopic analysis.

In one preferred embodiment of the invention the silver halide emulsion is dyed with a saturation or near saturation monolayer of one or more cyanine dyes which have at least one negatively charged substituent. The area a dye covers on the silver halide surface can be determined by preparing a dye concentration series and choosing the dye level for optimum performance or by well-known techniques such as dye adsorption isotherms (for example see W. West, B. H. Carroll, and D. H. Whitcomb, *J. Phys. Chem,* 56, 1054 (1962)). The second layer comprises at least one dye that has at least one positively charged substituent.

In one preferred embodiment, a molecule containing a group that strongly bonds to silver halide, such as a mercapto group (or a molecule that forms a mercapto group under alkaline or acidic conditions) or a thiocarbonyl group is added after the first dye layer has been formed and before the second dye layer is formed. Mercapto compounds represented by the following formula (A) are particularly preferred.

A

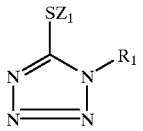

wherein $R_1$ represents an alkyl group, an alkenyl group or an aryl group and $Z_1$ represents a hydrogen atom, an alkali metal atom, an ammonium group or a protecting group that can be removed under alkaline or acidic conditions.

Examples of some preferred mercapto compounds are shown below:

A-1

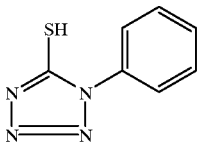

A-2

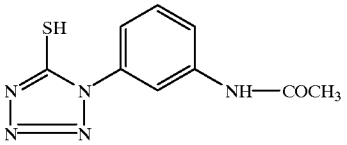

A-3

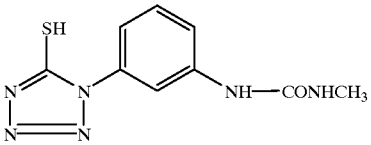

A-4

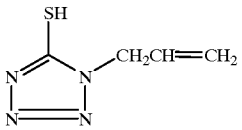

-continued

A-5

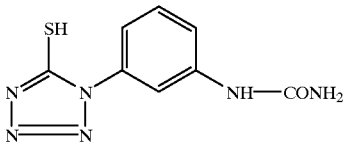

In describing preferred embodiments of the invention, one dye layer is described as an inner layer and one dye layer is described as an outer layer. It is to be understood that one or more intermediate layers may be present between the inner and outer dye layers, in which all of the layers are held together by non-covalent forces, as discussed in more detail above. These intermediate layers could be formed by dyes or other materials. Further, the dye layers need not completely encompass the silver halide grains or underlying dye layer (s). Also some mixing of the dyes between layers is possible. It is also possible that some dye from the outer layer co-adsorb with the dye of the inner dye layer on the silver halide grain.

The dyes of the inner dye layer are preferably any dyes capable of spectral sensitization, for example, a cyanine dye, merocyanine dye, complex cyanine dye, complex merocyanine dye, homopolar cyanine dye, or hemicyanine dye, etc. Of these dyes, merocyanine dyes containing a thiocarbonyl group and cyanine dyes are particularly useful. Of these cyanine dyes are especially useful. Particularly preferred is a cyanine dye of Formula Ia or a merocyanine dye of Formula Ib.

(Ia)

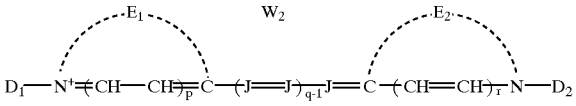

wherein:

$E_1$ and $E_2$ may be the same or different and represent the atoms necessary to form a substituted or unsubstituted heterocyclic ring which is a basic nucleus (see *The Theory of the Photographic Process,* $4^{th}$ edition, T. H. James, editor, Macmillan Publishing Co., New York, 1977 for a definition of basic and acidic nucleus);

each J independently represents a substituted or unsubstituted methine group;

q is a positive integer of from 1 to 4;

p and r each independently represents 0 or 1;

$D_1$ and $D_2$ each independently represents substituted or unsubstituted alkyl or substituted or unsubstituted aryl and at least one of $D_1$ and $D_2$ contains an anionic substituent; and at least one of $D_1$ and $D_2$ contains a hydrogen bond accepting substituent;

$W_2$ is one or more counterions as necessary to balance the charge;

(Ib)

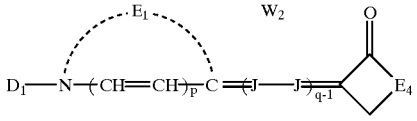

wherein:

$E_1$, $D_1$, J, p, q and $W_2$ are as defined above for formula (Ia);

$E_4$ represents the atoms necessary to complete a substituted or unsubstituted heterocyclic acidic nucleus which preferably contains a thiocarbonyl group.

The dyes of the outer dye layer are not necessarily spectral sensitizers. Examples of preferred outer layer dyes are a cyanine dye, merocyanine dye, arylidene dye, complex cyanine dye, complex merocyanine dye, homopolar cyanine dye, hemicyanine dye, styryl dye, hemioxonol dye, oxonol dye, anthraquinone dye, triphenylmethane dye, azo dye type, azomethines, coumarin dye or combinations of dyes from these classes. Particularly preferred are dyes having structure IIa, IIb, and IIc, (IIa)

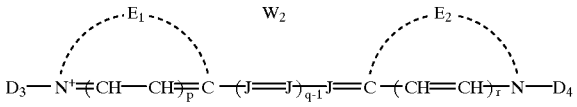

wherein:

$E_1$, $E_2$, J, p, q and $W_2$ are as defined above for Formula (Ia);

$D_3$ and $D_4$ each independently represents substituted or unsubstituted alkyl or substituted or unsubstituted aryl and at least one of $E_1$, $E_2$, J or $D_3$ and $D_4$ contains a cationic substituent and at least one of $E_1$, $E_2$, J or $D_3$ and $D_4$ contains a hydrogen bond donating substituent;

(IIb)

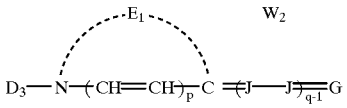

wherein:

$E_1$, $D_3$, J, p, q and $W_2$ are as defined above for Formula (I) and G represents

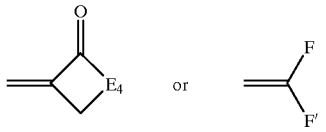

wherein $E_4$ represents the atoms necessary to complete a substituted or unsubstituted heterocyclic acidic nucleus, and F and F' each independently represents a cyano radical, an ester radical, an acyl radical, a carbamoyl radical or an alkylsulfonyl radical, and at least one of $E_1$, G, J or $D_3$ contains a cationic substituent and at least one of $E_1$, G, J or $D_3$ contains a hydrogen bond donating substituent;

(IIc)

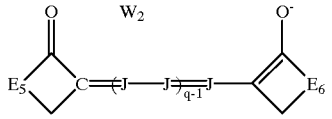

wherein:

J and $W_2$ are as defined above for Formula (I) above and q is 2,3 or 4, and $E_5$ and $E_6$ independently represent the atoms necessary to complete a substituted or unsubstituted acidic heterocyclic nucleus and at least one of J, $E_5$, or $E_6$ contains a cationic substituent and at least one of J, $E_5$, or $E_6$ contains a hydrogen bond donating substituent;

In embodiments of the invention in which the inner dye is of formula (Ia) and the outer dye is of formula (IIa), if either $D_1$ or $D_2$ contains an aromatic or heteroaromatic group then $D_3$ and $D_4$ do not contain an aromatic or heteroaromatic group.

Particularly preferred is a photographic material in which the inner dye layer comprises a cyanine dye of formula (Ic) and the outer dye layer comprises a dye of formula (IId):

Ic

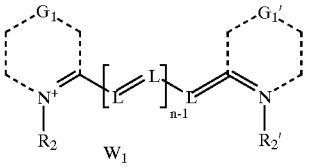

IId

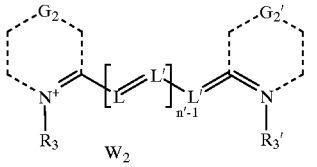

wherein:

$G_1$ and $G_1'$ independently represent the atoms necessary to complete a benzothiazole nucleus, benzoxazole nucleus, benzoselenazole nucleus, benzotellurazole nucleus, quinoline nucleus, or benzimidazole nucleus in which $G_1$ and $G_1'$ independently may be substituted or unsubstituted;

$G_2$ and $G_2'$ independently represent the atoms necessary to complete a benzothiazole nucleus, benzoxazole nucleus, benzoselenazole nucleus, benzotellurazole nucleus, quinoline nucleus, indole nucleus, or benzimidazole nucleus in which $G_2$, and $G_2'$ independently may be substituted or unsubstituted;

n and n' are independently a positive integer from 1 to 4;

each L and L' independently represent a substituted or unsubstituted methine group;

$R_2$ and $R_2'$ each independently represents substituted or unsubstituted aryl or substituted or unsubstituted aliphatic group, at least one of $R_2$ and $R_2'$ has a negative charge and at least one of $R_2$ and $R_2'$ has a has a hydrogen bond accepting substituent;

$W_1$ is a cationic counterion to balance the charge if necessary;

$R_3$ and $R_3'$ each independently represents substituted or unsubstituted aryl or substituted or unsubstituted aliphatic group and preferably at least one of $R_3$ and $R_3'$ has a positive charge; such that the net charge of IId is +2, +3, +4, or +5, and preferably at least one of $R_3$ and $R_3'$ has a hydrogen bond donating substituent;

$W_2$ is one or more anionic counterions to balance the charge.

In another preferred embodiment at least one dye of formula III is present

III

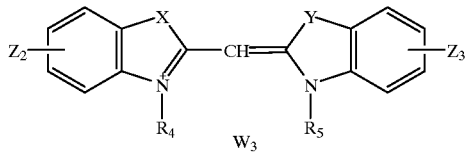

wherein:

X, Y, represent independently O, S, $NR_6$, Se, —CH=CH—, wherein $R_6$ represents substituted or unsubstituted alkyl or substituted or unsubstituted aryl;

$R_4$ and $R_5$ each independently represents substituted or unsubstituted alkyl or substituted or unsubstituted aryl and, preferably, at least one of $R_4$ and $R_5$ contains a hydrogen bonding donor substituent;

$Z_2$ and $Z_3$, each independently represents hydrogen or one or more substituents which, optionally, may form fused aromatic rings;

$W_3$ represents one or more counterions if necessary to balance a charge of the molecule.

In another preferred embodiment, at least one dye substituted with a substituent of formula IV is present:

IV

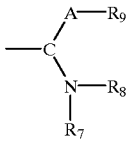

wherein $R_7$, $R_8$, $R_9$ independently represent hydrogen or substituted or unsubstituted alkyl or substituted or unsubstituted aryl or heteroatom (e.g., O, S, or N), and at least one of $R_7$, $R_8$, or $R_9$ independently represent hydrogen;

A independently represents N—$R_{10}$, O, S;

$R_9$ and $R_{10}$ independently represent hydrogen or substituted or unsubstituted alkyl or substituted or unsubstituted aryl;

$R_7$, $R_8$, $R_9$ or $R_{10}$ optionally may form one or more cyclic structures;

C atom in formula IV may be connected to N or A or another atom adjacent to said C atom with either a single or a double bond.

In a preferred embodiment the silver halide emulsion is dyed with a saturation or near saturation monolayer of one or more dyes wherein at least one dye is a cyanine dye with an anionic substituent. The second layer comprises one or more dyes wherein at least one dye has a substituent that contains a positive charge.

In another preferred embodiment the second layer comprises at least one cyanine dye with at least one substituent that contains a positive charge. In one preferred embodiment the substituent that contains positive charges is connected to the cyanine dye via the nitrogen atoms of the cyanine dye chromophore. However, preferably the anionic and cationic dyes of the invention do not both have an aromatic or heteroaromatic group attached to the dye by means of the nitrogen atoms of the cyanine chromophore.

Examples of positively charged substituents are unsubstituted or substituted ammonium, such as 3-(3-ammoniopropyl), 3-(4-ammoniobutyl), 3-(3-ammoniobutyl), 3-((2-ammonioethoxy)ethyl), 3-(5-ammoniopentyl), unsubstituted or substituted cyclohexylammonium, cyclopentylammonium, benzylammonium, etc. as well as secondary and tertiary ammonium groups such as 3-(3-methylammoniopropyl), 3-(3-ethylammoniopropyl), 3-(3,3'-dimethylammoniopropyl), 3-(3-ethylmethylammoniopropyl), 3-(3,3'-diethylammoniopropyl), 3-(4-methylammoniobutyl), imidazolyum, etc. These positively charged substituents can be formed in situ in the emulsion by protonation of the corresponding amino substituents such as by protonation of 3-(3-aminopropyl), 3-(4-aminobutyl), 3-(3-aminobutyl), 3-((2-aminoethoxy)ethyl), 3-(3-methylaminopropyl), 3-(3-ethylaminopropyl), 3-(3,3'-dimethylaminopropyl), 3-(3-ethylmethylaminopropyl), 3-(3,3'-diethylaminopropyl), 3-(4-methylammoniobutyl), etc. Positively charged substituents preferably also carry a hydrogen bonding donor group, such as NH, OH or SH. Other examples of positively charged substituents are 3-(3-guanidinopropyl), 3-(4-guanidinobutyl), 3-((2-guanidinoethoxy)ethyl), 3-(5-guanidinopentyl), 3-(3-amidinopropyl), 3-(4-amidinobutyl), 3-((2-amidinoethoxy)ethyl), 3-(5-amidinopentyl), and other unsubstituted or substituted amidinium, guanidinium, etc. cations or various imines of urea, thiouronium, aminoimidazoline, acylaminoimidazoline, acylguanidinium, methylguanidinium, dimethylguanidinium, cyanoguanidinium, aminoguanidinium, diaminoguanidinium, guanylurea, 2-imino-4-thiobluret, as well as substituents containing purine and pyrimidine heterocycles which have amidimium or guanidinium substructures.

The dyes of this invention can be synthesized by well-known methods. For example, reaction of excess of 1,4-bis(halo)butane with a dye base gives the corresponding quaternary salt. For example, reaction of 5 equivalents of 1,4-dioodobutane with 2-methyl-5-phenylbenzothiazole at 120°C. gave 2-methyl-5-phenyl-3-(4-iodobutyl) benzothiazolium iodide. Dyes were prepared from quaternary salt intermediates by standard methods such as described in Hamer, *Cyanine Dyes and Related Compounds,* 1964 (publisher John Wiley & Sons, New York, N.Y.) and James, *The Theory of the Photographic Process* 4th edition, 1977 (Eastman Kodak Company, Rochester, N.Y.). For example, a symmetrical dye was obtained from 2-methyl-5-phenyl-3-(4-iodobutyl)benzothiazolium iodide and isoamyl nitrite, acetic anhydride and pyridine in acetonitrile. Guanidine-substituted dyes were made from these materials by standard methods such as described in the literature: R. J. Bergeron, J. S. McManis *J. Org. Chem.* 1987, 52, 1700; G. Vaidyanathan, M. R. Zalutsky *J. Org. Chem.* 1997, 62, 4867; K. Feichtinger, H. L. Sings, T. J. Baker, K. Matthews, M. Goodman *J. Org. Chem.* 1998, 63, 8432. For example, N,N'-bis(tert-butoxycarbonyl)guanidine was reacted with sodium hydride and bis(4-iodobutyl) dye to produce protected bis-guanidine dye, which was further reacted with trifluoroacetic acid in dichloromethane to yield, after anion exchange and recrystallization, the bisguanidinium dye II-5. Alternatively, hydroxy- and aminoalkyl substituted dyes could be made and converted into guanidinium-substituted dyes using standard procedures described in the literature: D. S. Dodd, A. P. Kozikowski *Tetrahedron Lett.* 1994, 35, 977; M. S. Bernatowicz, Y. Wu, G. R. Matsueda *Tetrahedron Lett.* 1993, 34, 3389. Amino substituents are converted into ammonium substituents by protonation, either in situ in the emulsion, or before adding dyes to the emulsion by treatment with acid.

When reference in this application is made to a particular moiety as a "group", this means that the moiety may itself be unsubstituted or substituted with one or more substituents (up to the maximum possible number). For example, "alkyl group" refers to a substituted or unsubstituted alkyl, while "benzene group" refers to a substituted or unsubstituted benzene (with up to six substituents). Generally, unless otherwise specifically stated, substituent groups usable on molecules herein include any groups, whether substituted or unsubstituted, which do not destroy properties necessary for the photographic utility. Examples of substituents on any of the mentioned groups can include known substituents, such as: halogen, for example, chloro, fluoro, bromo, iodo; alkoxy, particularly those "lower alkyl" (that is, with 1 to 6 carbon atoms, for example, methoxy, ethoxy; substituted or unsubstituted alkyl, particularly lower alkyl (for example, methyl, trifluoromethyl); thioalkyl (for example, methylthio or ethylthio), particularly either of those with 1 to 6 carbon atoms; substituted and unsubstituted aryl, particularly those having from 6 to 20 carbon atoms (for example, phenyl); and substituted or unsubstituted heteroaryl, particularly those having a 5 or 6-membered ring containing 1 to 3 heteroatoms selected from N, O, or S (for example, pyridyl, thienyl, furyl, pyrrolyl); acid or acid salt groups such as any of those described below; and others known in the art. Alkyl substituents may specifically include "lower alkyl" (that is, having 1–6 carbon atoms), for example, methyl, ethyl, and the like. Further, with regard to any alkyl group or alkylene group, it will be understood that these can be branched or unbranched and include ring structures.

Particularly preferred dyes for use in accordance with this invention are given in Table I, however the dyes useful in the invention are not limited to these compounds. Examples of dyes valuable for primary sensitizers are of formula I in the Table. Examples of dyes useful as antenna dyes are of formula II in the Table. Dyes of formula I can sometimes be added as a third dye to aid in the stabilization of the antenna dye layer.

TABLE 1
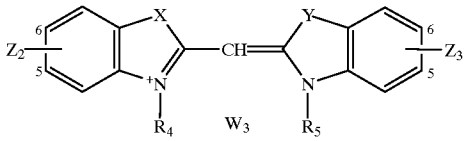
| Dye | $Z_2$ | $Z_3$ | X, Y | $R_4$ | $R_5$ | $W_3$ |
|---|---|---|---|---|---|---|
| I-1 | 5-Cl | 5-Cl | S, S | $(CH_2)_3SO_3^-$ | $(CH_2)_3SO_3^-$ | $TEAH^+$ |
| I-2 | 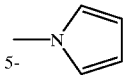 | 5-Cl | S, S | $(CH_2)_3SO_3^-$ | $(CH_2)_3SO_3^-$ | $TEAH^+$ |
| I-3 | 4,5-Benzo | 5-Cl | S, S | $(CH_2)_3SO_3^-$ | $(CH_2)_3SO_3^-$ | $TEAH^+$ |
| II-1 | 5-Cl | 5-Cl | S, S | 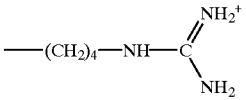 | $(CH_2)_3SO_3^-$ | $Br^-$ |
| II-2 | 5-Ph | 5-Ph | S, O | 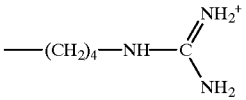 | $(CH_2)_3SO_3^-$ | $Cl^-$ |
| II-3 | 5-Ph | 5-Ph | S, S | 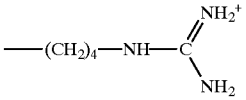 | $—CH_3$ | $2Cl^-$ |
| II-4 | 5-Ph | 5-Ph | S, O | 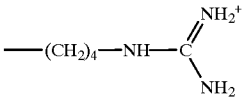 | $—(CH_2)_3N(Me)_3^+$ | $3Cl^-$ |
| II-5 | 5-Ph | 5-Ph | S, S | 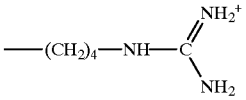 | 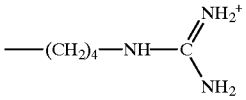 | $3Cl^-$ |

TABLE 1-continued
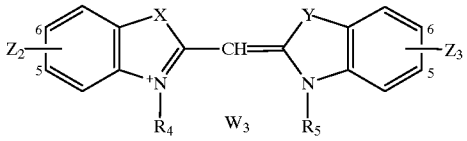
| Dye | $Z_2$ | $Z_3$ | X, Y | $R_4$ | $R_5$ | $W_3$ |
|---|---|---|---|---|---|---|
| II-6 | 5-Ph | 5-Ph | S, S | $-(CH_2)_2O(CH_2)_2-NH-C(=NH_2^+)NH_2$ | $-(CH_2)_2O(CH_2)_2-NH-C(=NH_2^+)NH_2$ | $3Cl^-$ |
| II-7 | 5-Ph | 5-Ph | S, O | $-(CH_2)_2O(CH_2)_2-NH-C(=NH_2^+)NH_2$ | $-(CH_2)_2O(CH_2)_2-NH-C(=NH_2^+)NH_2$ | $3Cl^-$ |
| II-8 | 5-Ph | 5-Ph | S, S | $-(CH_2)_3-NH-C(=NH_2^+)NH_2$ | $-(CH_2)_3-NH-C(=NH_2^+)NH_2$ | $3Cl^-$ |
| II-9 | 5-Ph | 5-Ph | S, O | $-(CH_2)_3-NH-C(=NH_2^+)NH_2$ | $-(CH_2)_3-NH-C(=NH_2^+)NH_2$ | $3Cl^-$ |
| II-10 | 5-Ph | 5-Cl | S, O | $-(CH_2)_3-NH-C(=NH_2^+)NH_2$ | $-(CH_2)_3-NH-C(=NH_2^+)NH_2$ | $3Cl^-$ |
| II-11 | 5- 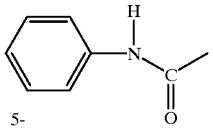 | 5- 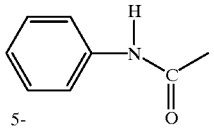 | S, S | $-(CH_2)_4-NH-C(=NH_2^+)NH_2$ | $-(CH_2)_4-NH-C(=NH_2^+)NH_2$ | $3Cl^-$ |

TABLE 1-continued
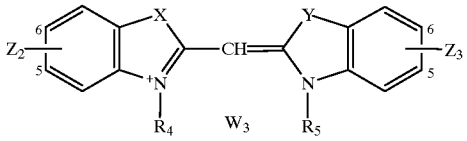
| Dye | $Z_2$ | $Z_3$ | X, Y | $R_4$ | $R_5$ | $W_3$ |
|---|---|---|---|---|---|---|
| II-12 | 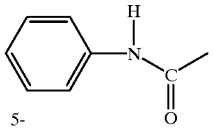 5- | 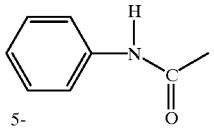 5- | S, S | 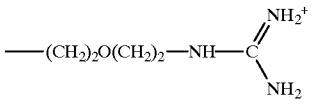 | 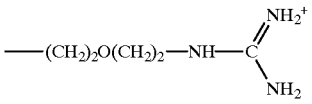 | $3Cl^-$ |
| II-13 | 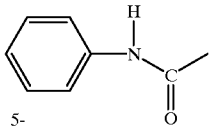 5- | 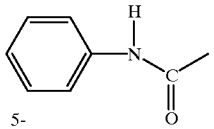 5- | S, O | 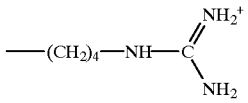 | 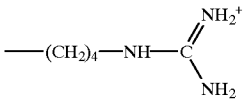 | $3Cl^-$ |
| II-14 | 5- 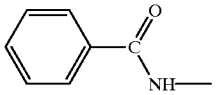 | 5- 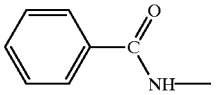 | S, S | 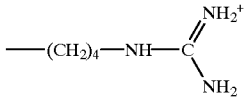 | 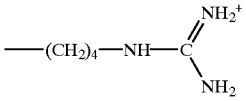 | $3Cl^-$ |
| II-15 | 5- 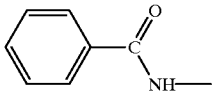 | 5-Ph | S, O | 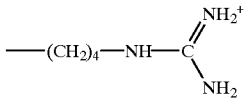 | 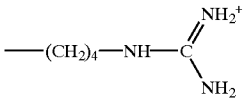 | $3Cl^-$ |
| II-16 | 5-Ph | 5-Ph | S, S | 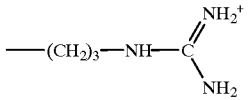 | 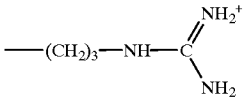 | $3Cl^-$ |

TABLE 1-continued
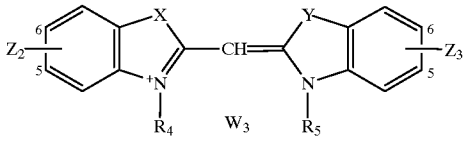
| Dye | $Z_2$ | $Z_3$ | X, Y | $R_4$ | $R_5$ | $W_3$ |
|---|---|---|---|---|---|---|
| II-17 | 5-Ph | 5-Ph | S, O | 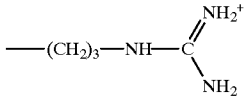 | 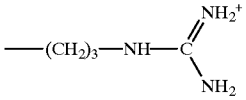 | $3Cl^-$ |
| II-18 | 5-Ph | 5-Ph | S, S | 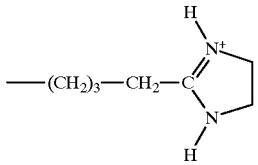 | 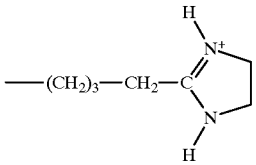 | $3Cl^-$ |
| II-19 | 5-Ph | 5-Ph | S, O | 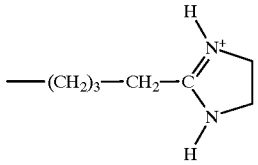 | 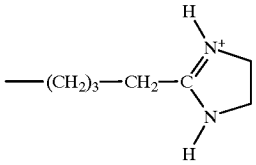 | $3Cl^-$ |
| II-20 | 5-Ph | 5-Ph | S, O | 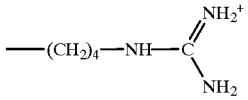 | 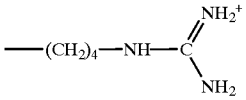 | $3Cl^-$ |
| II-21 | 5-Cl | 5-Cl | S, S | 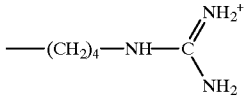 | 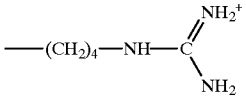 | $3Cl^-$ |
| II-22 | 5-Ph | 5-Cl | S, S | 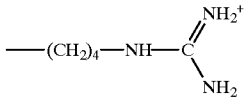 | 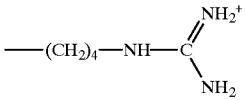 | $3Cl^-$ |

TABLE 1-continued
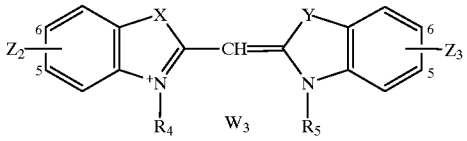
| Dye | $Z_2$ | $Z_3$ | X, Y | $R_4$ | $R_5$ | $W_3$ |
|---|---|---|---|---|---|---|
| II-23 | 5-Cl | 5-Ph | S, O | 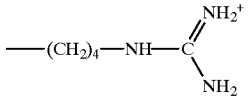 | 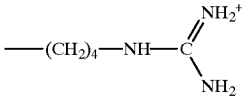 | $3Cl^-$ |
| II-24 | 5-Ph | 4,5Benzo | S, O | 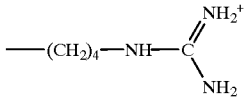 | 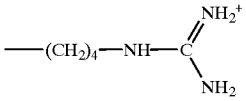 | $3Cl^-$ |
| II-25 | 5-Ph | 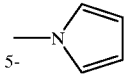 | S, O | 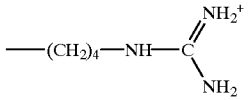 | 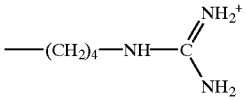 | $3Cl^-$ |
| II-26 | 5-Cl | 5-Cl | S, S | $—((CH_2)_2O)_2(CH_2)_2NH_2^+(Me)$ | $—((CH_2)_2O)_2(CH_2)_2NH_2^+(Me)$ | $3Cl^-$ |
| II-27 | 5-Ph | 5-Cl | S, S | $—(CH_2)_3NH_3^+$ | $—(CH_2)_3NH_3^+$ | $3Cl^-$ |
| II-28 | 5-Ph | 5-Cl | S, S | $—(CH_2)_4NH_3^+$ | $—(CH_2)_4NH_3^+$ | $3Cl^-$ |
| II-29 | 5-Cl | 5-Cl | S, S | $—(CH_2)_4NH_3^+$ | $—(CH_2)_4NH_3^+$ | $3Cl^-$ |
| II-30 | 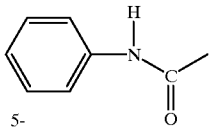 | 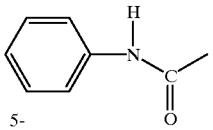 | S, S | $—(CH_2)_4NH_3^+$ | $—(CH_2)_4NH_3^+$ | $3Cl^-$ |

TABLE 1-continued
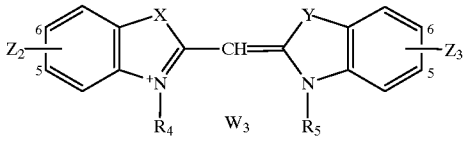
| Dye | $Z_2$ | $Z_3$ | X, Y | $R_4$ | $R_5$ | $W_3$ |
|---|---|---|---|---|---|---|
| II-31 | 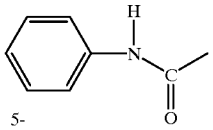 5- | 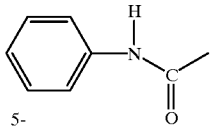 5- | S, S | $—(CH_2)_2O(CH_2)_2NH_3^+$ | $—(CH_2)_2O(CH_2)_2NH_3^+$ | $3Cl^-$ |
| II-32 | 5- 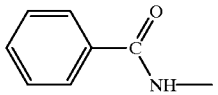 | 5- 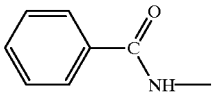 | S, S | $—(CH_2)_4NH_3^+$ | $—(CH_2)_4NH_3^+$ | $3Cl^-$ |
| II-33 | 5-Ph | 5-Ph | S, S | $—(CH_2)_2O(CH_2)_2NH_3^+$ | $—(CH_2)_2O(CH_2)_2NH_3^+$ | $3Cl^-$ |
| II-34 | 5-Ph | 5-Ph | S, S | $—(CH_2)_3NH_3^+$ | $—(CH_2)_3NH_3^+$ | $3Cl^-$ |
| II-35 | 5-Ph | 5-Ph | S, O | $—(CH_2)_3NH_3^+$ | $—(CH_2)_3NH_4^+$ | $3Cl^-$ |
| II-36 | 5-Ph | 5-Cl | S, S | $—(CH_2)_3NH_3^+$ | $(CH_2)_3SO_3^-$ | $Cl^-$ |
| II-37 | 5-Ph | 5-Cl | S, S | $—(CH_2)_3NH_3^+$ | $—C_2H_5$ | $2Cl^-$ |

The amount of sensitizing dye that is useful in the invention may be from 0.001 to 4 millimoles, but is preferably in the range of 0.01 to 4.0 millimoles per mole of silver halide and more preferably from 0.10 to 4.0 millimoles per mole of silver halide. Optimum dye concentrations can be determined by methods known in the art.

The silver halide may be sensitized by sensitizing dyes by any method known in the art, such as described in *Research Disclosure,* September 1996, Number 389, Item 38957, which will be identified hereafter by the term "Research Disclosure I." The dyes may, for example, be added as a solution or dispersion in water, alcohol, aqueous gelatin, alcoholic aqueous gelatin, microcrystalline dispersion, etc. Several dyes may be added simultaneously from a common solution or dispersion. The dye/silver halide emulsion may be mixed with a dispersion of color image-forming coupler immediately before coating or in advance of coating.

The emulsion layer of the photographic material of the invention can comprise any one or more of the light sensitive layers of the photographic material. The photographic materials made in accordance with the present invention can be black and white elements, single color elements or multicolor elements. Multicolor elements contain dye image-forming units sensitive to each of the three primary regions of the visible spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the visible spectrum can be disposed as a single segmented layer.

Photographic materials of the present invention may also usefully include a magnetic recording material as described in *Research Disclosure,* Item 34390, November 1992, or a transparent magnetic recording layer such as a layer containing magnetic particles on the underside of a transparent support as in U.S. Pat. Nos. 4,279,945 and 4,302,523. The element typically will have a total thickness (excluding the support) of from 5 to 30 microns. While the order of the color sensitive layers can be varied, they will normally be red-sensitive, green-sensitive and blue-sensitive, in that order on a transparent support, (that is, blue sensitive furthest from the support) and the reverse order on a reflective support being typical.

The present invention also contemplates the use of photographic materials of the present invention in what are often referred to as single use cameras (or "film with lens" units). These cameras are sold with film preloaded in them and the entire camera is returned to a processor with the exposed film remaining inside the camera. Such cameras may have glass or plastic lenses through which the photographic material is exposed.

In the following discussion of suitable materials for use in elements of this invention, reference will be made to "*Research Disclosure I.*" The Sections hereafter referred to are Sections of the Research Disclosure I unless otherwise indicated. All Research Disclosures referenced are published by Kenneth Mason Publications, Ltd., Dudley Annex, 12a North Street, Emsworth, Hampshire P010 7DQ, ENGLAND. The foregoing references and all other references cited in this application, are incorporated herein by reference.

The silver halide emulsions employed in the photographic materials of the present invention may be negative-working, such as surface-sensitive emulsions or unfogged internal latent image forming emulsions, or positive working emulsions of the internal latent image forming type (that are fogged during processing). Suitable emulsions and their preparation as well as methods of chemical and spectral sensitization are described in Sections I through V. Color materials and development modifiers are described in Sections V through XX. Vehicles which can be used in the photographic materials are described in Section II, and various additives such as brighteners, antifoggants, stabilizers, light absorbing and scattering materials, hardeners, coating aids, plasticizers, lubricants and matting agents are described, for example, in Sections VI through XIII. Manufacturing methods are described in all of the sections, layer arrangements particularly in Section XI, exposure alternatives in Section XVI, and processing methods and agents in Sections XIX and XX.

With negative working silver halide a negative image can be formed. Optionally a positive (or reversal) image can be formed although a negative image is typically first formed.

The photographic materials of the present invention may also use colored couplers (e.g to adjust levels of interlayer correction) and masking couplers such as those described in EP 213 490; Japanese Published Application 58-172,647; U.S. Pat. No. 2,983,608; German Application DE 2,706,117C; U.K. Patent 1,530,272; Japanese Application A-1 13935; U.S. Pat. No. 4,070,191 and German Application DE 2,643,965. The masking couplers may be shifted or blocked.

The photographic materials may also contain materials that accelerate or otherwise modify the processing steps of bleaching or fixing to improve the quality of the image. Bleach accelerators described in EP 193 389; EP 301 477; U.S. Pat. No. 4,163,669; U.S. Pat. No. 4,865,956; and U.S. Pat. No. 4,923,784 are particularly useful. Also contemplated is the use of nucleating agents, development accelerators or their precursors (UK Patent 2,097,140; U.K. Patent 2,131,188); development inhibitors and their precursors (U.S. Pat. No. 5,460,932; U.S. Pat. No. 5,478,711); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol or yellow and/or magenta filter dyes and/or antihalation dyes (particularly in an undercoat beneath all light sensitive layers or in the side of the support opposite that on which all light sensitive layers are located) either as oil-in-water dispersions, latex dispersions or as solid particle dispersions. Additionally, they may be used with "smearing" couplers (e.g as described in U.S. Pat. No. 4,366,237; EP 096 570; U.S. Pat. No. 4,420,556; and U.S. Pat. No. 4,543,323.) Also, the couplers may be blocked or coated in protected form as described, for example, in Japanese Application 61/258,249 or U.S. Pat. No. 5,019,492.

The photographic materials may further contain other image-modifying compounds such as "Development Inhibitor-Releasing" compounds (DIR's). Useful additional DIR's for elements of the present invention, are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601;

4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

DIR compounds are also disclosed in "Developer-Inhibitor-Releasing (DIR) Couplers for Color Photography," C. R. Barr, J. R. Thirtle and P. W. Vittum in *Photographic Science and Engineering,* Vol. 13, p. 174 (1969), incorporated herein by reference.

It is also contemplated that the concepts of the present invention may be employed to obtain reflection color prints as described in Research Disclosure, November 1979, Item 18716, available from Kenneth Mason Publications, Ltd, Dudley Annex, 12*a* North Street, Emsworth, Hampshire P0101 7DQ, England, incorporated herein by reference. The emulsions and materials to form elements of the present invention, may be coated on pH adjusted support as described in U.S. Pat. No. 4,917,994; with epoxy solvents (EP 0 164 961); with additional stabilizers (as described, for example, in U.S. Pat. No. 4,346,165; U.S. Pat. No. 4,540,653 and U.S. Pat. No. 4,906,559); with ballasted chelating agents such as those in U.S. Pat. No. 4,994,359 to reduce sensitivity to polyvalent cations such as calcium; and with stain reducing compounds such as described in U.S. Pat. No. 5,068,171 and U.S. Pat. No. 5,096,805. Other compounds which may be useful in the elements of the invention are disclosed in Japanese Published Applications 83-09,959; 83-62,586; 90-072,629; 90-072,630; 90-072,632; 90-072,633; 90-072,634; 90-077,822; 90-078,229; 90-078,230; 90-079,336; 90-079,338; 90-079,690; 90-079,691; 90-080,487; 90-080,489; 90-080,490; 90080,491; 90-080,492; 90-080,494; 90-085,928; 90-086,669; 90-086,670; 90-087,361; 90-087,362; 90-087,363; 90-087,364; 90-088,096; 90-088,097; 90-093,662; 90-093,663; 90-093,664; 90-093,665; 90-093,666; 90-093,668; 90-094,055; 90-094,056; 90-101,937; 90-103,409; 90-151,577.

The silver halide used in the photographic materials may be silver iodobromide, silver bromide, silver chloride, silver chlorobromide, silver chloroiodobromide, and the like.

The type of silver halide grains preferably include polymorphic, cubic, and octahedral. The grain size of the silver halide may have any distribution known to be useful in photographic compositions, and may be either polydispersed or monodispersed. Tabular grain silver halide emulsions may also be used.

Tabular grains are silver halide grains having parallel major faces and an aspect ratio of at least 2, where aspect ratio is the ratio of grain equivalent circular diameter (ECD) divided by grain thickness (t). The equivalent circular diameter of a grain is the diameter of a circle having an area equal to the projected area of the grain. A tabular grain emulsion is one in which tabular grains account for greater than 50 percent of total grain projected area. In preferred tabular grain emulsions tabular grains account for at least 70 percent of total grain projected area and optimally at least 90 percent of total grain projected area. It is possible to prepare tabular grain emulsions in which substantially all (>97%) of the grain projected area is accounted for by tabular grains. The non-tabular grains in a tabular grain emulsion can take any convenient conventional form. When coprecipitated with the tabular grains, the non-tabular grains typically exhibit the same silver halide composition as the tabular grains.

The tabular grain emulsions can be either high bromide or high chloride emulsions. High bromide emulsions are those in which silver bromide accounts for greater than 50 mole percent of total halide, based on silver. High chloride emulsions are those in which silver chloride accounts for greater than 50 mole percent of total halide, based on silver. Silver bromide and silver chloride both form a face centered cubic crystal lattice structure. This silver halide crystal lattice structure can accommodate all proportions of bromide and chloride ranging from silver bromide with no chloride present to silver chloride with no bromide present. Thus, silver bromide, silver chloride, silver bromochloride and silver chlorobromide tabular grain emulsions are all specifically contemplated. In naming grains and emulsions containing two or more halides, the halides are named in order of ascending concentrations. Usually high chloride and high bromide grains that contain bromide or chloride, respectively, contain the lower level halide in a more or less uniform distribution. However, non-uniform distributions of chloride and bromide are known, as illustrated by Maskasky U.S. Pat. Nos. 5,508,160 and 5,512,427 and Delton U.S. Pat. Nos. 5,372,927 and 5,460,934, the disclosures of which are here incorporated by reference.

It is recognized that the tabular grains can accommodate iodide up to its solubility limit in the face centered cubic crystal lattice structure of the grains. The solubility limit of iodide in a silver bromide crystal lattice structure is approximately 40 mole percent, based on silver. The solubility limit of iodide in a silver chloride crystal lattice structure is approximately 11 mole percent, based on silver. The exact limits of iodide incorporation can be somewhat higher or lower, depending upon the specific technique employed for silver halide grain preparation. In practice, useful photographic performance advantages can be realized with iodide concentrations as low as 0.1 mole percent, based on silver. It is usually preferred to incorporate at least 0.5 (optimally at least 1.0) mole percent iodide, based on silver. Only low levels of iodide are required to realize significant emulsion speed increases. Higher levels of iodide are commonly incorporated to achieve other photographic effects, such as interimage effects. Overall iodide concentrations of up to 20 mole percent, based on silver, are well known, but it is generally preferred to limit iodide to 15 mole percent, more preferably 10 mole percent, or less, based on silver. Higher than needed iodide levels are generally avoided, since it is well recognized that iodide slows the rate of silver halide development.

Iodide can be uniformly or non-uniformly distributed within the tabular grains. Both uniform and non-uniform iodide concentrations are known to contribute to photographic speed. For maximum speed it is common practice to distribute iodide over a large portion of a tabular grain while increasing the local iodide concentration within a limited portion of the grain. It is also common practice to limit the concentration of iodide at the surface of the grains. Preferably the surface iodide concentration of the grains is less than 5 mole percent, based on silver. Surface iodide is the iodide that lies within 0.02 nm of the grain surface.

With iodide incorporation in the grains, the high chloride and high bromide tabular grain emulsions contemplated within the invention extend to silver iodobromide, silver iodochloride, silver iodochlorobromide and silver iodobromochloride tabular grain emulsions.

When tabular grain emulsions are spectrally sensitized, as herein contemplated, it is preferred to limit the average thickness of the tabular grains to less than 0.3 μm. Most preferably the average thickness of the tabular grains is less than 0.2 μm. In a specific preferred form the tabular grains are ultrathin—that is, their average thickness is less than 0.07 μm.

The useful average grain ECD of a tabular grain emulsion can range up to about 15 μm. Except for a very few high speed applications, the average grain ECD of a tabular grain emulsion is conventionally less than 10 μm, with the average grain ECD for most tabular grain emulsions being less than 5 μm.

The average aspect ratio of the tabular grain emulsions can vary widely, since it is quotient of ECD divided grain thickness. Most tabular grain emulsions have average aspect ratios of greater than 5, with high (>8) average aspect ratio emulsions being generally preferred. Average aspect ratios ranging up to 50 are common, with average aspect ratios ranging up to 100 and even higher, being known.

The tabular grains can have parallel major faces that lie in either {100} or {111 } crystal lattice planes. In other words, both {111 } tabular grain emulsions and {100} tabular grain emulsions are within the specific contemplation of this invention. The {111 } major faces of {111 } tabular grains appear triangular or hexagonal in photomicrographs while the {100} major faces of {100} tabular grains appear square or rectangular.

High chloride {111 } tabular grain emulsions are specifically contemplated, as illustrated by the following patents herein incorporated by reference:

Wey et al U.S. Pat. No. 4,414,306;
Maskasky U.S. Pat. No. 4,400,463;
Maskasky U.S. Pat. No. 4,713,323;
Takada et al U.S. Pat. No. 4,783,398;
Nishikawa et al U.S. Pat. No. 4,952,508;
Ishiguro et al U.S. Pat. No. 4,983,508;
Tufano et al U.S. Pat. No. 4,804,621;
Maskasky U.S. Pat. No. 5,061,617;
Maskasky U.S. Pat. No. 5,178,997;
Maskasky and Chang U.S. Pat. No. 5,178,998;
Maskasky U.S. Pat. No. 5,183,732;
Maskasky U.S. Pat. No. 5,185,239;
Maskasky U.S. Pat. No. 5,217,858; and
Chang et al U.S. Pat. No. 5,252,452.

Since silver chloride grains are most stable in terms of crystal shape with {100 } crystal faces, it is common practice to employ one or more grain growth modifiers during the formation of high chloride {111 } tabular grain emulsions. Typically the grain growth modifier is displaced prior to or during subsequent spectral sensitization, as illustrated by Jones et al U.S. Pat. No. 5,176,991 and Maskasky U.S. Pat. Nos. 5,176,992, 5,221,602, 5,298,387 and 5,298,388, the disclosures of which are herein incorporated by reference.

Preferred high chloride tabular grain emulsions are {100} tabular grain emulsions, as illustrated by the following patents, herein incorporated by reference:

Maskasky U.S. Pat. No. 5,264,337;
Maskasky U.S. Pat. No. 5,292,632;
House et al U.S. Pat. No. 5,320,938;
Maskasky U.S. Pat. No. 5,275,930;
Brust et al U.S. Pat. No. 5,314,798;
Chang et al U.S. Pat. No. 5,413,904;
Budz et al U.S. Pat. No. 5,451,490;
Maskasky U.S. Pat. No. 5,607,828;
Chang et al U.S. Pat. No. 5,663,041;
Reed et al U.S. Pat. No. 5,695,922; and
Chang et al U.S. Pat. No. 5,744,297.

Since high chloride {100} tabular grains have {100} major faces and are, in most instances, entirely bounded by {100} grain faces, these grains exhibit a high degree of grain shape stability and do not require the presence of any grain growth modifier for the grains to remain in a tabular form following their precipitation.

High bromide {100} tabular grain emulsions are known, as illustrated by Mignot U.S. Pat. No. 4,386,156 and Gourlaouen et al U.S. Pat. No. 5,726,006 , the disclosures of which are herein incorporated by reference. It is, however, generally preferred to employ high bromide tabular grain emulsions in the form of {111 } tabular grain emulsions, as illustrated by the following patents, herein incorporated by reference:

Kofron et al U.S. Pat. No. 4,439,520;
Wilgus et al U.S. Pat. No. 4,434,226;
Solberg et al U.S. Pat. No. 4,433,048;
Maskasky U.S. Pat. No. 4,435,501;
Maskasky U.S. Pat. No. 4,463,087;
Daubendiek et al U.S. Pat. No. 4,414,310;
Daubendiek et al U.S. Pat. No. 4,672,027;
Daubendiek et al U.S. Pat. No. 4,693,964;
Maskasky U.S. Pat. No. 4,713,320;
Daubendiek et al U.S. Pat. No. 4,914,014;
Piggin et al U.S. Pat. No. 5,061,616;
Piggin et al U.S. Pat. No. 5,061,609;
Bell et al U.S. Pat. No. 5,132,203;
Antoniades et al U.S. Pat. No. 5,250,403;
Tsaur et al U.S. Pat. No. 5,147,771;
Tsaur et al U.S. Pat. No. 5,147,772;
Tsaur et al U.S. Pat. No. 5,147,773;
Tsaur et al U.S. Pat. No. 5,171,659;
Tsaur et al U.S. Pat. No. 5,252,453,
Brust U.S. Pat. No. 5,248,587;
Black et al U.S. Pat. No. 5,337,495;
Black et al U.S. Pat. No. 5,219,720;
Delton U.S. Pat. No. 5,310,644;
Chaffee et al U.S. Pat. No. 5,358,840;
Maskasky U.S. Pat. No. 5,411,851;
Maskasky U.S. Pat. No. 5,418,125;
Wen U.S. Pat. No. 5,470,698;
Mignot et al U.S. Pat. No. 5,484,697;
Olm et al U.S. Pat. No. 5,576,172;
Maskasky U.S. Pat. No. 5,492,801;
Daubendiek et al U.S. Pat. No. 5,494,789;
King et al U.S. Pat. No. 5,518,872;
Maskasky U.S. Pat. No. 5,604,085;
Reed et al U.S. Pat. No. 5,604,086;
Eshelman et al U.S. Pat. No. 5,612,175;
Eshelman et al U.S. Pat. No. 5,612,176;
Levy et al U.S. Pat. No. 5,612,177;
Eshelman et al U.S. Pat. No. 5,14,359;
Maskasky U.S. Pat. No. 5,620,840;
Irving et al U.S. Pat. No. 5,667,954;
Maskasky U.S. Pat. No. 5,667,955;

Maskasky U.S. Pat. No. 5,693,459;

Irving et al U.S. Pat. No. 5,695,923;

Reed et al U.S. Pat. No. 5,698,387;

Deaton et al U.S. Pat. No. 5,726,007;

Irving et al U.S. Pat. No. 5,728,515;

Maskasky U.S. Pat. No. 5,733,718; and

Brust U.S. Pat. No. 5,763,151.

In many of the patents listed above (starting with Kofron et al, Wilgus et al and Solberg et al, cited above) speed increases without accompanying increases in granularity are realized by the rapid (a.k.a. dump) addition of iodide for a portion of grain growth. Chang et al U.S. Pat. No. 5,314,793 correlates rapid iodide addition with crystal lattice disruptions observable by stimulated X-ray emission profiles.

Localized peripheral incorporations of higher iodide concentrations can also be created by halide conversion. By controlling the conditions of halide conversion by iodide, differences in peripheral iodide concentrations at the grain corners and elsewhere along the edges can be realized. For example, Fenton et al U.S. Pat. No. 5,476,76 discloses lower iodide concentrations at the corners of the tabular grains than elsewhere along their edges. Jagannathan et al U.S. Pat. Nos. 5,723,278 and 5,736,312 disclose halide conversion by iodide in the corner regions of tabular grains.

Crystal lattice dislocations, although seldom specifically discussed, are a common occurrence in tabular grains. For example, examinations of the earliest reported high aspect ratio tabular grain emulsions (e.g., those of Kofron et al, Wilgus et al. and Solberg et al., cited above) reveal high levels of crystal lattice dislocations. Black et al. U.S. Pat. No. 5,709,988 correlates the presence of peripheral crystal lattice dislocations in tabular grains with improved speed-granularity relationships. Ikeda et al. U.S. Pat. No. 4,806,461 advocates employing tabular grain emulsions in which at least 50 percent of the tabular grains contain 10 or more dislocations. For improving speed-granularity characteristics, it is preferred that at least 70 percent and optimally at least 90 percent of the tabular grains contain 10 or more peripheral crystal lattice dislocations.

The silver halide grains to be used in the invention may be prepared according to methods known in the art, such as those described in *Research Disclosure I* and *The Theory of the Photographic Process,* 4th edition, T. H. James, editor, Macmillan Publishing Co., New York, 1977. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc., at suitable values during formation of the silver halide by precipitation.

In the course of grain precipitation one or more dopants (grain occlusions other than silver and halide) can be introduced to modify grain properties. For example, any of the various conventional dopants disclosed in *Research Disclosure I,* Section I. Emulsion grains and their preparation, sub-section G. Grain modifying conditions and adjustments, paragraphs (3), (4) and (5), can be present in the emulsions of the invention. In addition it is specifically contemplated to dope the grains with transition metal hexacoordination complexes containing one or more organic ligands, as taught by Olm et al. U.S. Pat. No. 5,360,712, the disclosure of which is herein incorporated by reference.

It is specifically contemplated to incorporate in the face centered cubic crystal lattice of the grains a dopant capable of increasing imaging speed by forming a shallow electron trap (hereinafter also referred to as a SET) as discussed in *Research Disclosure* Item 36736 published November 1994, here incorporated by reference.

The SET dopants are effective at any location within the grains. Generally better results are obtained when the SET dopant is incorporated in the exterior 50 percent of the grain, based on silver. An optimum grain region for SET incorporation is that formed by silver ranging from 50 to 85 percent of total silver forming the grains. The SET can be introduced all at once or run into the reaction vessel over a period of time while grain precipitation is continuing. Generally SET forming dopants are contemplated to be incorporated in concentrations of at least $1\times10^{-7}$ mole per silver mole up to their solubility limit, typically up to about $5\times10^{-4}$ mole per silver mole.

SET dopants are known to be effective to reduce reciprocity failure. In particular the use of iridium hexacoordination complexes or $Ir^{+4}$ complexes as SET dopants is advantageous.

Iridium dopants that are ineffective to provide shallow electron traps (non-SET dopants) can also be incorporated into the grains of the silver halide grain emulsions to reduce reciprocity failure.

To be effective for reciprocity improvement the Ir can be present at any location within the grain structure. A preferred location within the grain structure for Ir dopants to produce reciprocity improvement is in the region of the grains formed after the first 60 percent and before the final 1 percent (most preferably before the final 3 percent) of total silver forming the grains has been precipitated. The dopant can be introduced all at once or run into the reaction vessel over a period of time while grain precipitation is continuing. Generally reciprocity improving non-SET Ir dopants are contemplated to be incorporated at their lowest effective concentrations.

The contrast of the photographic material can be further increased by doping the grains with a hexacoordination complex containing a nitrosyl or thionitrosyl ligand (NZ dopants) as disclosed in McDugle et al. U.S. Pat. No. 4,933,272, the disclosure of which is herein incorporated by reference.

The contrast increasing dopants can be incorporated in the grain structure at any convenient location. However, if the NZ dopant is present at the surface of the grain, it can reduce the sensitivity of the grains. It is therefore preferred that the NZ dopants be located in the grain so that they are separated from the grain surface by at least 1 percent (most preferably at least 3 percent) of the total silver precipitated in forming the silver iodochloride grains. Preferred contrast enhancing concentrations of the NZ dopants range from $1\times10^{-11}$ to $4\times10^{-8}$ mole per silver mole, with specifically preferred concentrations being in the range from $10^{-10}$ to $10^{-8}$ mole per silver mole.

Although generally preferred concentration ranges for the various SET, non-SET Ir and NZ dopants have been set out above, it is recognized that specific optimum concentration ranges within these general ranges can be identified for specific applications by routine testing. It is specifically contemplated to employ the SET, non-SET Ir and NZ dopants singly or in combination. For example, grains containing a combination of an SET dopant and a non-SET Ir dopant are specifically contemplated. Similarly SET and NZ dopants can be employed in combination. Also NZ and Ir dopants that are not SET dopants can be employed in combination. Finally, the combination of a non-SET Ir dopant with a SET dopant and an NZ dopant. For this latter three-way combination of dopants it is generally most convenient in terms of precipitation to incorporate the NZ dopant first, followed by the SET dopant, with the non-SET Ir dopant incorporated last.

The photographic materials of the present invention, as is typical, provide the silver halide in the form of an emulsion. Photographic emulsions generally include a vehicle for coating the emulsion as a layer of a photographic material. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), deionized gelatin, gelatin derivatives (e.g., acetylated gelatin, phthalated gelatin, and the like), and others as described in *Research Disclosure I.* Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I.* The vehicle can be present in the emulsion in any amount useful in photographic emulsions. The emulsion can also include any of the addenda known to be useful in photographic emulsions.

The silver halide to be used in the invention may be advantageously subjected to chemical sensitization. Compounds and techniques useful for chemical sensitization of silver halide are known in the art and described in *Research Disclosure I* and the references cited therein. Compounds useful as chemical sensitizers, include, for example, active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 4 to 8, and temperatures of from 30 to 80° C., as described in *Research Disclosure I,* Section IV (pages 510–511) and the references cited therein.

Photographic materials of the present invention are preferably imagewise exposed using any of the known techniques, including those described in *Research Disclosure I,* section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like).

Photographic materials comprising the composition of the invention can be processed in any of a number of well-known photographic processes utilizing any of a number of well-known processing compositions, described, for example, in *Research Disclosure I,* or in *The Theory of the Photographic Process,* $4^{th}$ edition, T. H. James, editor, Macmillan Publishing Co., New York, 1977. In the case of processing a negative working element, the element is treated with a color developer (that is one which will form the colored image dyes with the color couplers), and then with an oxidizer and a solvent to remove silver and silver halide. In the case of processing a reversal color element, the element is first treated with a black and white developer (that is, a developer which does not form colored dyes with the coupler compounds) followed by a treatment to fog silver halide (usually chemical fogging or light fogging), followed by treatment with a color developer. Preferred color developing agents are p-phenylenediamines. Especially preferred are:

4-amino N,N-diethylaniline hydrochloride,
4-amino-3-methyl-N,N-diethylaniline hydrochloride,
4-amino-3-methyl-N-ethyl-N-(β-(methanesulfonamido) ethylaniline sesquisulfate hydrate,
4-amino-3-methyl-N-ethyl-N-(β-hydroxyethyl)aniline sulfate,
4-amino-3-β-(methanesulfonamido)ethyl-N,N-diethylaniline hydrochloride and
4-amino-N-ethyl-N-(2-methoxyethyl)-m-toluidine di-p-toluene sulfonic acid.

Dye images can be formed or amplified by processes which employ in combination with a dye-image-generating reducing agent an inert transition metal-ion complex oxidizing agent, as illustrated by Bissonette U.S. Pat. Nos. 3,748,138, 3,826,652, 3,862,842 and 3,989,526 and Travis U.S. Pat. No. 3,765,891, and/or a peroxide oxidizing agent as illustrated by Matejec U.S. Pat. No. 3,674,490, *Research Disclosure,* Vol. 116, December, 1973, Item 11660, and Bissonette *Research Disclosure,* Vol. 148, August, 1976, Items 14836, 14846 and 14847. The photographic materials can be particularly adapted to form dye images by such processes as illustrated by Dunn et al. U.S. Pat. No. 3,822,129, Bissonette U.S. Pat. Nos. 3,834,907 and 3,902,905, Bissonette et al. U.S. Pat. No. 3,847,619, Mowrey U.S. Pat. No. 3,904,413, Hirai et al U.S. Pat. No. 4,880,725, Iwano U.S. Pat. No. 4,954,425, Marsden et al. U.S. Pat. No. 4,983,504, Evans et al. U.S. Pat. No. 5,246,822, Twist U.S. Pat. No. 5,324,624, Fyson EPO 0 487 616, Tannahill et al. WO 90/13059, Marsden et al. WO 90/13061, Grimsey et al. WO 91/16666, Fyson WO 91/17479, Marsden et al. WO 92/01972. Tannahill WO 92/05471, Henson WO 92/07299, Twist WO 93/01524 and WO 93/11460 and Wingender et al. German OLS 4,211,460.

Development is followed by bleach-fixing, to remove silver or silver halide, washing and drying.

Photographic Evaluation

EXAMPLE 1

Film coating evaluations were carried out in color format on a sulfur-and-gold sensitized 3.7 μm ×0.11 μm silver bromide tabular emulsion containing iodide (3.6 mol %). Details of the precipitation of this emulsion can be found in Fenton, et al., U.S. Pat. No. 5,476,760. Briefly, 3.6% KI was run after precipitation of 70% of the total silver, followed by a silver over-run to complete the precipitation. The emulsion contained 50 mppm of tetrapotassium hexacyanoruthenate ($K_4Ru(CN)_6$) added between 66 and 67% of the silver precipitation. The emulsion (0.0143 mole Ag), was heated to 40° C. and sodium thiocyanate (100 mg/Ag mole) was added and after a 20' hold the first sensitizing dye was added (see Table II for dye and level). After an additional 20' a gold salt (bis[2,3-dihydro-1,4,5-trimethyl-3-(thioxo-kS)- 1H-1,2,4-triazoliumato]-gold, tetrafluoroborate, 2.4 mg/Ag mole), sulfur agent (N-((dimethylamino)thioxomethyl)-N-methylglycine, sodium salt, 2.3 mg/Ag mole) and an antifoggant (3-(3-((methylsulfonyl)amino)-3-oxopropyl)-benzothiazolium tetrafluoroborate), 37 mg/Ag mole) were added at 5' intervals, the melt was held for 20' and then heated to 60° C. for 20'. After cooling to 40° C., 75 mg/Ag mole of 1-(3-acetamidophenyl)-5-mercaptotetrazole was added. The second dye, when present, was added to the melt (see Table II for dye and level). After 30' at 40° C., gelatin (647 g/Ag mole total), distilled water (sufficient to bring the final concentration to 0.11 Ag mmole/g of melt) and tetraazaindine (1.0 g/Ag mole) were added.

Single-layer coatings were made on acetate support. Total gelatin laydown was 4.8 g/m$^2$ (450 mg/ft$^2$). Silver laydown was 0.5 g/m$^2$ (50 mg/ft$^2$). The emulsion was combined with a coupler dispersion containing Y-1, a yellow dye-forming coupler, just prior to coating.

Y-1

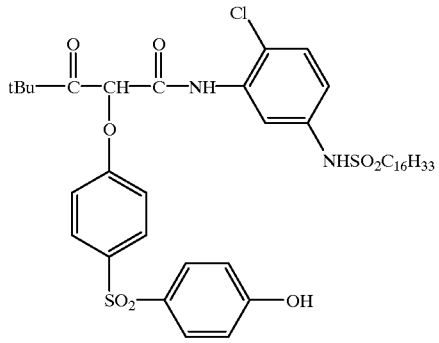

Sensitometric exposures (0.01 sec) were done using tungsten exposure with filtration to simulate a daylight exposure. The described elements were processed for 3.25' in the known C-41 color process as described in *Brit. J. Photog. Annual* of 1988, p191–198 with the exception that the composition of the bleach solution was changed to comprise propylenediaminetetraacetic acid. Results are shown in the Table II.

TABLE II

Sensitometric Evaluation of Dyes in Photographic Example 1.

| Example | | First Dye | First Dye Level[a] | Second Dye | Second Dye Level[a] | Speed[b] (log E) | Relative Sensitivity |
|---|---|---|---|---|---|---|---|
| 1-1 | C | I-1 | 1.00 | — | | 2.80 | 100 |
| 1-2 | C | I-1 | 1.00 | I-1 | 1.00 | 2.72 | 83 |
| 1-3 | I | I-1 | 1.00 | II-5 | 1.00 | 2.91 | 129 |
| 1-4 | I | I-1 | 1.00 | II-21 | 1.00 | 2.85 | 112 |
| 1-5 | I | I-1 | 1.00 | II-20 | 1.00 | 2.90 | 126 |
| 1-6 | I | I-1 | 1.00 | II-2 | 1.00 | 2.86 | 115 |
| 1-7 | I | I-1 | 1.00 | II-29 | 1.00 | 2.85 | 112 |
| 1-8 | I | I-1 | 1.00 | II-11 | 1.00 | 2.90 | 126 |
| 1-9 | I | I-1 | 1.00 | II-31 | 1.00 | 2.97 | 148 |
| 1-10 | I | I-1 | 1.00 | II-12 | 1.00 | 3.01 | 162 |
| 1-11 | I | I-1 | 1.00 | II-34 | 1.00 | 2.90 | 126 |
| 1-12 | I | I-1 | 1.00 | II-25 | 1.00 | 2.88 | 120 |

I = invention, C is comparison.
[a]mmol dye/silver mole.
[b]speed from an exposure that simulates a daylight exposure, measured at a density of 0.15 above Dmin.

It can be seen from Table II that the dyes of the invention afford increased photographic sensitivity. Examples of the Second Dye that contain hydrogen-bonding donor groups in addition to opposite charge to the First Dye show significantly increased photographic sensitivity over the comparison dyes in a color coating format.

Photographic Evaluation

EXAMPLE 2

An emulsion precipitated in the same manner as in Example 1 (0.0143 mole Ag), was heated to 40° C. and sodium thiocyanate (100 mg/Ag mole) was added and after a 20' hold the first sensitizing dye was added (see Tables III and IV for dye and level). After an additional 20' a gold salt (bis[2,3-dihydro-1,4,5-trimethyl-3-(thioxo-kS)-1H-1,2,4-triazoliumato]-gold, tetrafluoroborate, 2.4 mg/Ag mole), sulfur agent (N-((dimethylamino)thioxomethyl)-N-methylglycine, sodium salt, 2.3 mg/Ag mole) and an antifoggant (3-(3-((methylsulfonyl)amino)-3-oxopropyl)-benzothiazolium tetrafluoroborate), 37 mg/Ag mole) were added at 5' intervals, the melt was held for 20' and then heated to 60° C. for 20'. After cooling to 40° C., 75 mg/Ag mole of 1-(3-acetamidophenyl)-5-mercaptotetrazole was added. The second dye, when present, was added to the melt (see Tables III and IV for dye and level). After 30' at 40° C., gelatin (647 g/Ag mole total), distilled water (sufficient to bring the final concentration to 0.11 Ag mmole/g of melt) and tetrazaindine (1.0 g/Ag mole) were added. Coating and evaluations were carried out in color format as described in Example 1. Results are shown in the Table IV.

TABLE III

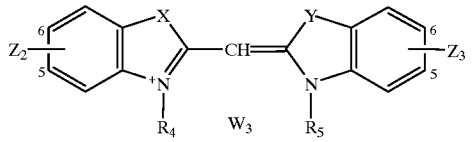

| Dye | $Z_2$ | $Z_3$ | X, Y | $R_4$ | $R_5$ | $W_3$ |
|---|---|---|---|---|---|---|
| C-1 | 5-Cl | 5-Cl | S,S | $—(CH_2)_3N(Me)_3^+$ | $—(CH_2)_3N(Me)_3^+$ | $3Br^-$ |
| C-2 | 5-Cl | 5-Cl | S,S | $—(CH_2)_3N(Me)_3^+$ | $—C_2H_5$ | $2Br^-$ |

TABLE IV

Sensitometric Evaluation of Dyes in Photographic Example 2.

| Example | First Dye | First Dye Level[a] | Second Dye | Second Dye Level[a] | Speed[b] (-log E) | Relative Sensitivity |
|---|---|---|---|---|---|---|
| 2-1 C | I-1 | 1.00 | — | — | 2.67 | 100 |
| 2-2 C | I-1 | 1.00 | C-1 | 1.00 | 2.62 | 89 |
| 2-3 C | I-1 | 1.00 | C-2 | 1.00 | 2.69 | 105 |

I = invention, C is comparison.
[a]mmol dye/silver mole.
[b]speed from an exposure that simulates a daylight exposure, measured at a density of 0.15 above Dmin.

It can be seen from Table IV that Examples of the Second Dye that do not contain hydrogen-bonding donor groups in addition to opposite charge to the First Dye show little or no increased photographic sensitivity over the comparison dyes in a color coating format, in contrast to the dyes of the invention shown in Example 1.

The invention has been described in detail with particular reference to preferred embodiments, but it will be understood that variations and modifications can be effected within the spirit and scope of the invention.

What is claimed is:

1. A silver halide photographic material comprising at least one silver halide emulsion comprising silver halide grains having associated therewith a combination of two or more light absorption-increasing dyes wherein:

(a) a light absorption-increasing dye having at least one substituent that has a negative charge is present, and (b) a light absorption-increasing dye having at least one substituent that has a positive charge and which is a cyanine dye, a merocyanine dye, an arylidene dye, a complex cyanine dye, a complex merocyanine dye, a homopolar cyanine dye, a styryl dye, a hemioxonol dye, an oxonol dye, an anthraquinone dye, a triphenylmethane dye, an azo dye type, an azomethine dye, or a coumarin dye is present, wherein at least one of the light absorption-increasing dyes is further substituted with at least one hydrogen bonding donor substituent.

2. A silver halide photographic material according to claim 1 wherein at least one of the dye substituents has been protonated in situ in the emulsion to form a positive charge.

3. A silver halide photographic material according to claim 1 wherein one of the dyes is substituted with a primary or secondary or tertiary ammonium group.

4. A silver halide photographic material according to claim 1 wherein one of the dyes is substituted with at least two ammonium groups, and at least one ammonium group is primary or secondary or tertiary.

5. A silver halide photographic material according to claim 1, which contains at least one dye of formula III

III

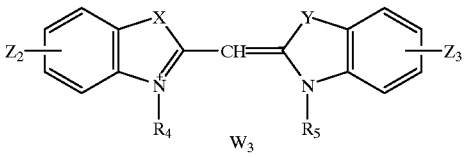

wherein

X and Y independently represent O, S, $NR_6$, Se, —CH═CH— and $R_6$ represents substituted or unsubstituted alkyl or substituted or unsubstituted aryl;

$R_4$ and $R_5$ independently represent substituted or unsubstituted alkyl or substituted or unsubstituted aryl;

$Z_2$ and $Z_3$, each independently represents hydrogen or one or more substituents which, optionally, may form fused aromatic rings;

$W_3$ represents one or more counterions if necessary to balance a charge of the molecule.

6. A silver halide photographic material according to claim 5 wherein at least one of $R_4$, $R_5$, $Z_2$ or $Z_3$ is substituted with a positively charged substituent.

7. A silver halide photographic material according to claim 5 wherein at least one of $R_4$, $R_5$, $Z_2$ or $Z_3$ is substituted with a substituent which has been protonated in situ in the emulsion to form a positive charge.

8. A silver halide photographic material according to claim 5 wherein at least one of $R_4$, $R_5$, $Z_2$ or $Z_3$ is substituted with a hydrogen bonding donor substituent.

9. A silver halide photographic material according to claim 5 wherein the dye of formula III is substituted with a primary or secondary or tertiary ammonium group.

10. A silver halide photographic material according to claim 5 wherein at least one of $R_4$ or $R_5$ is substituted with a primary or secondary or tertiary ammonium group.

11. A silver halide photographic material according to claim 5 wherein both $R_4$ and $R_5$ are substituted with at least two ammonium groups, and at least one ammonium group is primary or secondary or tertiary.

12. A silver halide photographic material comprising at least one silver halide emulsion comprising silver halide grains having associated therewith a light-absorption-increasing dye substitute with at least one guanidinium, amidinium, or imine of urea substituent.

13. A silver halide photographic material according to claim 12 comprising at least one other dye in addition to said light absorption-increasing dye.

14. A silver halide photographic material comprising at least one silver halide emulsion comprising silver halide grains having associated therewith a combination of two or more light absorption-increasing dyes wherein:

(a) a light absorption-increasing dye having at least one substituent that has a negative charge is present, and (b) a light absorption-increasing dye having at least one substituent that has a positive charge is present, wherein at least one of the light absorption-increasing dyes is further substituted with at least two hydrogen bonding donor substituents.

15. A silver halide photographic material comprising at least one silver halide emulsion comprising silver halide grains having associated therewith a combination of two or more light absorption-increasing dyes wherein:

(a) a light absorption-increasing dye having at least one substituent that has a negative charge is present, and (b) a light absorption-increasing dye having at least one substituent that has a positive charge is present, and wherein at least one of the light absorption-increasing dyes is further substituted with at least one guanidine or guanidinium group, which could in turn be substituted or unsubstituted.

16. A silver halide photographic material according to claim 15 wherein one of the light absorption-increasing dyes is substituted with two guanidine or guanidinium groups, which could in turn be substituted or unsubstituted.

17. A silver halide photographic material comprising at least one silver halide emulsion comprising silver halide grains having associated therewith a combination of two or more light absorption-increasing dyes wherein:

(a) a light absorption-increasing dye having at least one substituent that has a negative charge is present, and (b) a light absorption-increasing dye having at least one substituent that has a positive charge is present, and wherein at least one of the light absorption-increasing dyes is represented by Formula III.

III

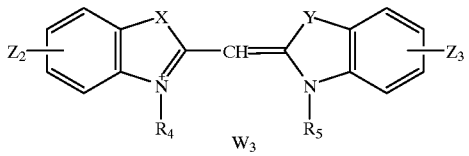

wherein

X and Y independently represent O, S, $NR_6$, Se, —CH═CH— and $R_6$ represents substituted or unsubstituted alkyl or substituted or unsubstituted aryl;

$R_4$ and $R_5$ independently represent substituted or unsubstituted alkyl or substituted or unsubstituted aryl;

$Z_2$ and $Z_3$, each independently represents hydrogen or one or more substituents which, optionally, may form fused aromatic rings;

$W_3$ represents one or more counterions if necessary to balance a charge of the molecule; and the dye of formula III is substituted with at least one guanidine or guanidinium groups, which could in turn be substituted or unsubstituted.

18. A silver halide photographic material according to claim 17 wherein at least one of $R_4$ or $R_5$ is substituted with guanidine or guanidinium group, which could in turn be substituted or unsubstituted.

19. A silver halide photographic material according to claim 17 wherein both $R_4$ and $R_5$ are substituted with guanidine or guanidinium groups, which could in turn be substituted or unsubstituted.

20. A silver halide photographic material comprising at least one silver halide emulsion comprising silver halide grains having associated therewith a combination of two or more light absorption-increasing dyes wherein:

(a) a light absorption-increasing dye having at least one substituent that has a negative charge is present, and (b) a light absorption-increasing dye having at least one substituent that has a positive charge is present, and wherein at least one of the light absorption-increasing dyes is substituted with a substituent of formula IV

IV

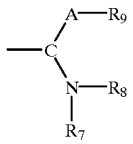

wherein $R_7$, $R_8$, $R_9$ independently represent hydrogen or substituted or unsubstituted alkyl or substituted or unsubstituted aryl or heteroatom, and at least one of $R_7$, $R_8$, or $R_9$ independently represent hydrogen;

A independently represents N—$R_{10}$, O, S;

$R_{10}$ independently represents hydrogen or substituted or unsubstituted alkyl or substituted or unsubstituted aryl;

$R_7$, $R_8$, $R_9$ or $R_{10}$ optionally may form one or more cyclic structures; and the C atom in formula IV may be connected to N or A or another atom adjacent to said C atom with either a single or a double bond.

21. A silver halide photographic material according to claim 20 wherein A represents N—$R_{10}$.

22. A silver halide photographic material according to claim 20 wherein at least two of $R_7$, $R_8$, or $R_9$ independently represent H.

23. A silver halide photographic material according to claim 20 wherein $R_7$, $R_8$, and $R_9$ represent H.

24. A silver halide photographic material according to claim 20 wherein the substituent represented by formula IV has a positive charge and a hydrogen bonding donor substituent.

25. A silver halide photographic material comprising at least one silver halide emulsion comprising silver halide grains having associated therewith a combination of two or more light absorption-increasing dyes wherein:

(a) a light absorption-increasing dye having at least one substituent that has a negative charge is present, and (b) a light absorption-increasing dye having at least one substituent that has a positive charge is present, wherein at least one of the light absorption-increasing dyes is further substituted with at least one hydrogen bonding donor substituent; and wherein a compound containing a mercapto group or a thiocarbonyl group is added after said dye having at least one substituent that has a negative charge is added.

* * * * *